US011495914B2

(12) United States Patent
Dobernig et al.

(10) Patent No.: US 11,495,914 B2
(45) Date of Patent: Nov. 8, 2022

(54) CONNECTOR ASSEMBLY WITH SEALED SYMMETRICAL SPLIT LEVER

(71) Applicant: Aptiv Technologies Limited, St. Michael (BB)

(72) Inventors: Norbert Dobernig, Nuremberg (DE); Rainer Schmidt, Nuremberg (DE); Prasanna Ramakrishnan, Tamilnadu (IN); Ramakrishna Manne, Andhra Pradesh (IN)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 17/381,582

(22) Filed: Jul. 21, 2021

(65) Prior Publication Data

US 2022/0311184 A1 Sep. 29, 2022

(30) Foreign Application Priority Data

Aug. 11, 2020 (GB) ..... 2012509

(51) Int. Cl.

| | |
|---|---|
| ***H01R 13/639*** | (2006.01) |
| ***H01R 13/629*** | (2006.01) |
| ***H01R 13/641*** | (2006.01) |
| ***H01R 13/52*** | (2006.01) |
| ***H01R 13/502*** | (2006.01) |

(52) U.S. Cl.

CPC ..... *H01R 13/62955* (2013.01); *H01R 13/502* (2013.01); *H01R 13/521* (2013.01); *H01R 13/62938* (2013.01); *H01R 13/639* (2013.01); *H01R 13/641* (2013.01)

(58) Field of Classification Search

CPC ..... H01R 13/62955; H01R 13/502; H01R 13/521; H01R 13/62938; H01R 13/639; H01R 13/641; H01R 13/62961

See application file for complete search history.

(56) References Cited

U.S. PATENT DOCUMENTS

| | | | |
|---|---|---|---|
| 5,252,084 | A | 10/1993 | Wakata |
| 5,417,513 | A | 5/1995 | Hayashi |

(Continued)

FOREIGN PATENT DOCUMENTS

| | | | |
|---|---|---|---|
| DE | 19611873 | A1 | 10/1997 |
| EP | 2656449 | A1 | 10/2013 |

(Continued)

*Primary Examiner* — Tho D Ta

(74) *Attorney, Agent, or Firm* — Billion & Armitage

(57) ABSTRACT

The present disclosure provides a connector assembly. The connector assembly includes a connector housing adapted to engage with a corresponding counter-connector housing. A lever including a first lever arm and a second lever arm is pivotably and sealingly mounted to the connector housing. Each lever arm includes interlocking means for connecting the first lever arm to the second lever arm at a first location. The interlocking means of each of the first lever arm and the second lever arm are configured to define complementary symmetrical surfaces that interlock with one another when the lever arms are pivotably mounted to the connector housing. On mounting the lever arms to the connector housing, the lever is configured to move about the connector housing between an open state and a closed state to secure the counter-connector housing to the connector housing.

20 Claims, 15 Drawing Sheets

(56) References Cited

U.S. PATENT DOCUMENTS

| | | | | |
|---|---|---|---|---|
| 5,597,315 | A * | 1/1997 | Taguchi | H01R 13/62972 439/157 |
| 7,785,131 | B2 * | 8/2010 | Ferderer | H01R 13/62933 439/372 |
| 9,692,153 | B1 * | 6/2017 | Rodriguez | H01R 13/62966 |

FOREIGN PATENT DOCUMENTS

| | | | |
|---|---|---|---|
| JP | H0548246 | U | 6/1993 |
| WO | 2010070395 | A1 | 6/2010 |

* cited by examiner

CONNECTOR ASSEMBLY WITH SEALED SYMMETRICAL SPLIT LEVER

CROSS-REFERENCE TO RELATED APPLICATION

This application claims benefit of priority to Patent Application No. GB 2012509.2 filed in the UK Intellectual Property Office on Aug. 11, 2020, the entire disclosure of which is hereby incorporated by reference.

TECHNICAL FIELD OF THE INVENTION

The present application relates in general to a connector assembly and in particular to a connector assembly for automotive applications including a pivotable lever to assist in the mating of a connector housing with a corresponding counter-connector housing.

BACKGROUND

Modern vehicles include a host of electrical devices distributed over the entire vehicle. Electrical connectors, such as door to body connectors, may be used to connect electrical components placed in car doors such as door locks, door airbags etc., to corresponding electronic controllers. In general, connectors placed at a junction between the car body and the car door of the vehicle are subject to rigorous environmental demands a demand exists for providing reliable waterproof and dustproof connector assemblies, in particular for more reliable waterproof and dustproof door to body connector assemblies due to the increasing complexity and importance of electronics which must be connected through the aforementioned junction.

Traditionally, slider connectors have been used for this type of door-to-body connection. However, these slider connectors require substantial force in order to mate the connector housings together, which may increase the complexity of the assembly process, thereby increasing the risk that connector housings are incorrectly assembled and potentially causing them to malfunction during operation. Unless the appropriate force is applied, which is difficult to gauge without the use of specialized instruments, there is a risk that the connector may become loose and disconnect during operation.

Connectors with a mate assist function have been developed in order to reduce the force required to mate connector housings together. This mate assist function is often in the form of a lever, in which one of the connector housings is moved towards the other connector housing through means of a rotating lever which actuates a cam type member action within the two connectors.

As these connectors are used in an outdoor environment, it is necessary to provide a connector which is both waterproof and dustproof, and thus a sealing arrangement is also required which does not hinder the rotational movement of the lever. The method of installing the lever on the connector and method of rotating the lever must not negatively affect the performance of the sealing member. It is widely acknowledged that U-shaped levers are difficult to install as the lever must be sufficiently rigid to withstand the force required to activate the mate assist function with the rotation of the lever but must also be sufficiently flexible to be securely fitted to the connector; an activity which often involves the resilient deformation of parts of the lever.

Levers which are made up of several components and which are assembled into a lever on the connector have thus been developed in an effort to overcome some of these issues.

While there has been a lot of development in the field of electric connectors, including the development of various lever configurations to improve performance, it is clear that problems such as lack of mate assist robustness, difficulty of use, difficultly in assembling the components of the connector or lever, complexity of manufacturing and maintaining the integrity of the internal space of the connector through means of a seal still need to be addressed in the development of the next generation of electrical components connectors.

SUMMARY

According to a first aspect of the present disclosure there is provided a connector assembly including;

- a connector housing adapted to engage with a corresponding counter-connector housing;
- a lever including a first lever arm and a second lever arm, each lever arm including interlocking means for connecting the first lever arm to the second lever arm at a first location, each lever arm including at a second location a first mounting member configured to cooperate with a complementary second mounting member on the connector housing for pivotably and sealingly mounting each lever arm to a corresponding location on the connector housing. The interlocking means of each of the first lever arm and the second lever arm are configured to define complementary symmetrical surfaces that interlock with one another when the lever arms are pivotably mounted to the connector housing. On mounting the lever arms to the connector housing, the lever is configured to move about the connector housing between an open state and a closed state to secure the counter-connector to the connector housing.

According to embodiments of the present disclosure, a sealing member is provided in sealing contact with corresponding sealing surfaces on the lever arms and the connector housing.

According to embodiments of the present disclosure, the sealing member is integrally formed on each of the lever arms and/or the connector housing.

According to embodiments of the present disclosure, the sealing member is formed using a 2K injection molding process.

The connector assembly of the present disclosure provides by means of a split lever, a mate assist function for securing the connector housings to one another. The split lever may be formed by connecting two lever arms provided with substantially symmetrical interlocking means that are arranged to interconnect with one another when the lever arms are mounted on the connector housing. For example, two symmetrical levers, which may be substantially identical to one another, may be used to form the lever. As such, the connector assembly of the present disclosure requires a reduced number of different parts, which would simplify the manufacture as well as the assembly process. The connector assembly as described above is protected from dust and moisture when the pivotable lever is in both a static and dynamic state. Providing symmetrical levers may be beneficial in that they can be mass produced, thus lowering production cost. As the lever arms are symmetrical, there is no question of confusion as to how to orient the levers or which lever to use in which location, thus easing the burden of installation of the connector. As the lever includes two parts which are assembled first to the connector and then interconnected to each other, the risk of inadvertently damaging the seal on installation is greatly reduced. As the seal is a 2 k molded seal, which is produced as part of the manufacturing process of the connector housing, there is no parting line which increases the integrity of the seal. Furthermore, because the lever is made of two separate lever arms, it is possible to manufacture the lever arms without a parting line. As such, the sealing function of the lever, when mounted on the connector housing may be greatly improved.

According to embodiments of the present disclosure, the connector housing includes two apertures provided on opposing sides of the connector housing, each aperture configured to receive a locking member of a lever arm.

According to embodiments of the present disclosure, the locking member includes a locking element which is configured to cooperate, when the lever moves to the closed position, with a mating surface of the counter-connector housing to secure the counter-connector housing to the connector housing.

According to embodiments of the present disclosure, the locking element is in the form of a gear including at least one gear tooth configured to engage with a recess on the counter-connector.

According to embodiments of the present disclosure, the first and second mounting members include one of a retaining latch and a notch adapted to cooperate with one another for mounting each lever arm to opposing locations on the connector housing. The retaining latch may be provided with a catching member, which is configured to engage with a surface of the notch when the lever is mounted on the connector housing thus securely mounting the lever to the connector housing.

According to embodiments of the present disclosure, the notch defines a substantially circular rim configured to engage with a corresponding retaining latch. The rim may be provided around the corresponding apertures provided on the connector housing. The rim may be continuous or discontinuous, and greatly reduces the risk of a lever being accidentally disengaged from the connector housing while pivoting between the open and the closed states.

The connector as described above benefits from a mate assist function in that the gear enables the counter-connector to be moved into the connector when the lever is rotated. Due to the split nature of the lever, as the lever is installed on the connector in parts, the requirement for flexibility in the body of the lever is greatly reduced, as such, it is possible to apply more force to the lever, without risk of lever or cam breakage, as the lever may be manufactured from more robust materials.

According to embodiments of the present disclosure, the counter-connector housing includes an engagement surface adapted to cooperate with a corresponding engagement surface on the connector housing or the locking member of a lever arm. For example, the corresponding engagement surface may include one of at least one boss and an opening. For example, one or more bosses may be provided on the counter-connector housing that may be adapted to cooperate with corresponding mating surfaces on the connector housing and/or the locking member of the lever. The corresponding mating surfaces may be in the form of an opening, a lip, a rim, a notch, and the like.

According to embodiments of the present disclosure, the interlocking means of each lever arm include a locking element and a guiding element.

According to embodiments of the present disclosure, the guiding element includes a protruding elongate member and a corresponding slot configured for receiving an elongated member of the other lever arm.

According to embodiments of the present disclosure, wherein the locking element includes a protruding locking member and a corresponding resilient member which defines a locking aperture configured for receiving and securing a protruding locking member of the other lever arm.

The use of a locking and guiding elements on the interlocking means ensure ease of assembly and further ensures that risk of becoming disengaged, once the lever arms are mounted on the connector housing, is greatly reduced.

According to embodiments of the present disclosure, the lever includes first connecting means configured to cooperate with corresponding second connecting means on the connector housing for releasably securing the lever on the connector housing, when the lever is in the closed position, wherein the first connecting means and second connecting means include interconnecting elements configured to engage with one another.

The connector assembly of the present disclosure further provides connecting means on the connector housing and the lever, which are configured to be engaged when the lever is in the closed position. As such, they prevent the lever from accidentally pivoting from the closed position to the open position. Preferably, when the first and second connecting means become engaged, an audible sound may be generated, indicating that the first and second connecting means have engaged. As such, the present disclosure ensures that the risk of not fully rotating the lever to the closed position during assembly is substantially reduced.

According to embodiments of the present disclosure, the connector assembly includes a connector position assurance (CPA) member, the CPA member being movable from a start position to an end position, wherein at the end position the CPA member prevents the latching means from disengaging.

The CPA feature of the present disclosure is advantageously provided to further enhance the connection of the first and second connecting means provided on the connector housing and the lever. The lever as disclosed above benefits from a CPA member which ensures that once the lever is in position; the lever cannot be accidentally rotated thus causing components of the connector assembly to become disengaged. As a result, the closed position, and thus the engagement of the connector housing with the counter-connection housing, is assured.

According to embodiments of the present disclosure, the interlocking means of the first lever arm and the second lever arm are symmetrically arranged about a central axis of rotation of the lever.

According to embodiments of the present disclosure, the lever arms are made of a glass fiber reinforced thermoplastic material including between 20% to 50% of fiber content.

As the lever arms are separately mounted on the connector housing, the flexibility requirements of the lever are greatly reduced. As such, the lever arms may be made of a glass fiber reinforced thermoplastic material including between 20% to 50% fiber content. For example, the glass fiber content may include at least 30% fiber content.

According to a second aspect of the present disclosure, a method for assembling an electrical connector is provided. The electrical connector including a connector housing, a corresponding counter-connector housing, and a lever including a first lever arm and a second lever arm which are identical, each lever arm including interlocking means for connecting the first lever arm to the second lever arm at a first location, the method including the steps of:

presenting the first lever arm and the second lever to the connector housing on opposite sides thereof;

biasing the interlocking means of each arm towards the interlocking means of the other arm to effect an interlock of the first and second arms, the interlock effecting a sealed connection of the lever arms to the connector housing;

engaging the connector housing with the corresponding counter-connecting housing; and pivoting the lever relative to the connector housing to effect a locking of the connector housing with the corresponding counter-connecting housing.

According to embodiments of the present disclosure, the method for assembling the electrical connector includes the step of activating the mate assist function includes rotating the lever to the closed position until an audible sound is generated from the engagement of corresponding connecting means provided on the lever and the connector housing.

The provision of a split symmetrical lever according to embodiments of the present disclosure allows for a less complex manufacturing process to be employed. More specifically, each lever arm of the lever may be manufactured using a single mold. As such, no parting line is formed on the sealing surface of the lever arms. The absence of a parting line on the sealing surface substantially increases the sealing contact with the sealing member and thus enhances the reliability of the connector. In a preferred embodiment the lever arms are identical, and as such only one mold needs to be provided, which significantly reduces the cost and complexity of the manufacturing process.

BRIEF DESCRIPTION OF THE DRAWINGS

The present invention will now be described, by way of example with reference to the accompanying drawings, in which.

DETAILED DESCRIPTION

Figure 1:
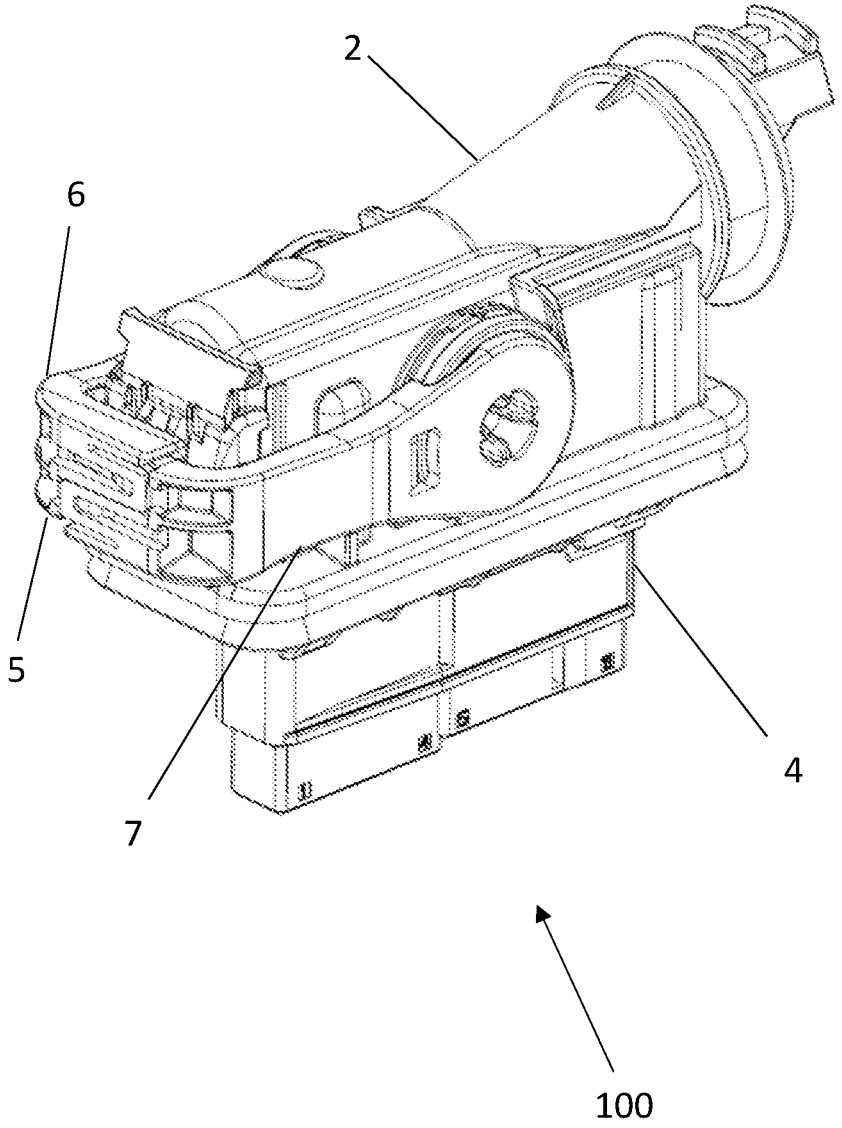
FIG. 1 illustrates a perspective view of a sealed electrical connector assembly with a symmetrical split lever according to an embodiment of the present disclosure.

The following discussion provides many exemplary embodiments of the inventive subject matter. Although each embodiment represents a single combination of inventive elements, the inventive subject matter is considered to include all possible combinations of the disclosed elements. Thus, if one embodiment includes elements A, B, and C, and a second embodiment includes elements B and D, then the inventive subject matter is also considered to include other remaining combinations of A, B, C, or D, even if not explicitly disclosed.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Referring now to FIGS. 1 to 13 of the accompanying drawings, there is illustrated an example of an electrical connector assembly 100 with symmetrical split lever 5 which is designed to easily and efficiently connect and secure two electrical components in an environment which may be subject to dust and/or moisture. The electrical connector assembly 100 may be used as a door-to-body connector in automotive applications.

As shown in FIG. 1, the electrical connector assembly 100 includes a connector housing 2 and a counter-connector housing 4 which may engage together in a male-female connection. More particularly, the connector housing 2 may include a female connector housing and the counter-connector housing 4 may include a male connector housing.

The electrical connector assembly 100 is provided with a two-part lever 5. The lever 5 includes a first lever arm 6 and a second lever arm 7, wherein the lever arms 6,7 may be provided with symmetrical features. For example, the lever arms 6, 7 may be provided with interlocking means 8 including symmetrical complementary surfaces. The lever arms 6,7 may be made from the same mould or made on the same manufacturing line. Preferably, the lever arms 6,7 are substantially identical, and as such may be interchangeable with one another. It should be appreciated that the term substantially identical implies that the lever arms 6,7 are identical in terms of relevant technical features but may include negligible irrelevant dissimilarities which do not affect the functioning of the lever arms 6,7 such as for example manufacturing imperfections etc. As shown in FIG. 1, the lever arms are pivotably mounted on opposing sides of the connector housing 2.

Figure 2:
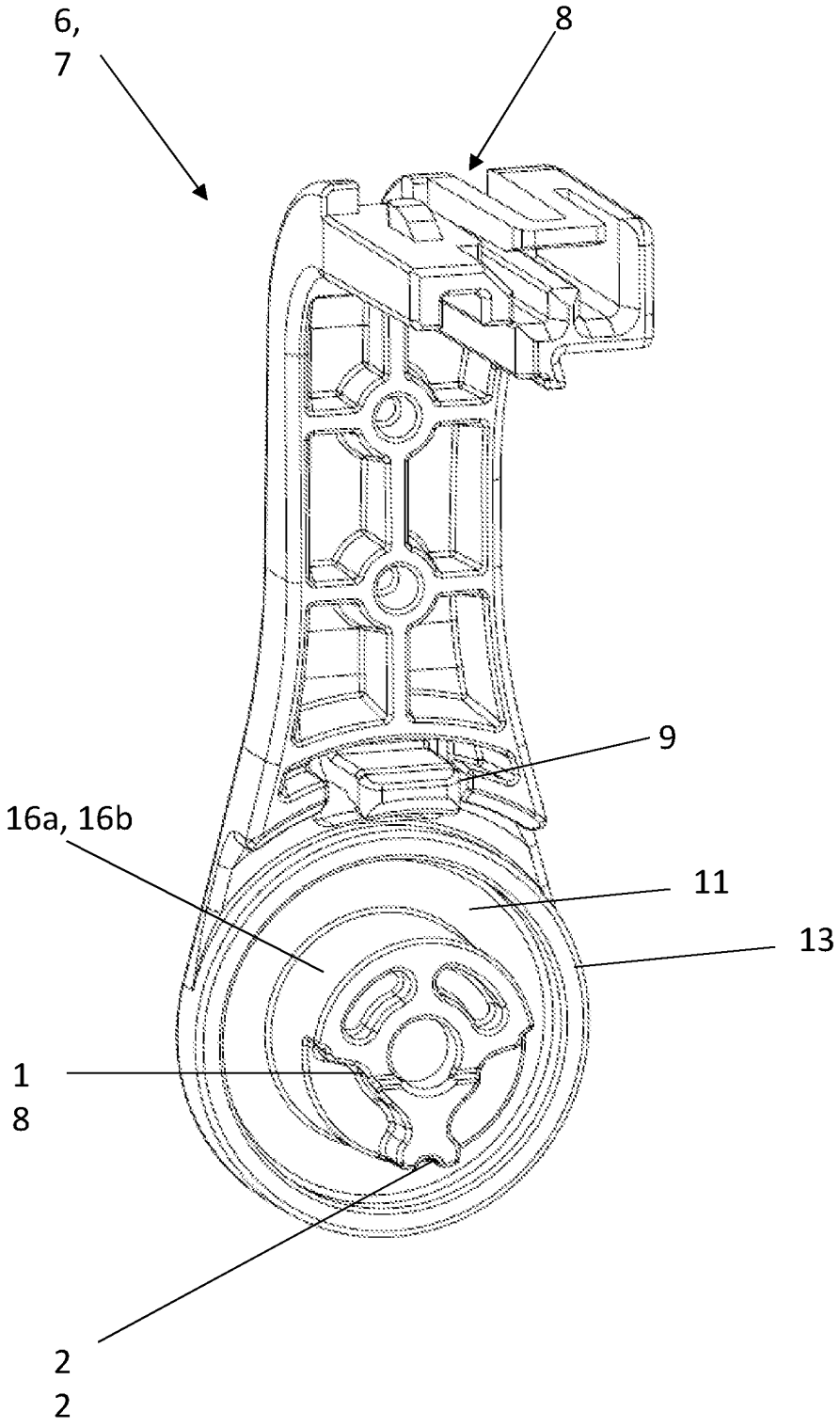
FIG. 2 illustrates a perspective view of a lever arm according to an embodiment of the present disclosure.

As shown in FIG. 2, each lever arm 6, 7 includes an interlocking means 8 which may be located at an end of the lever arm 6, 7 and a mounting means 9, 10 which may be located at an opposite end of the lever arm 6, 7. The interlocking means 8 of the lever arms 6, 7 include symmetrical features which form complementary interlocking surface that are configured to interlock with one another when the lever arms 6, 7 are connected. For example, the interlocking means 8 of the first lever arm 6 interlocks with the interlocking means 8 of the second lever arm 7 when the lever arms 6,7 are arranged about a central axis of rotation of the lever 5, in other words, when both the interlocking surfaces are in contact with each other. Each interlocking means 8 may include a guiding element 30 and a locking element 28.

Figure 3A:
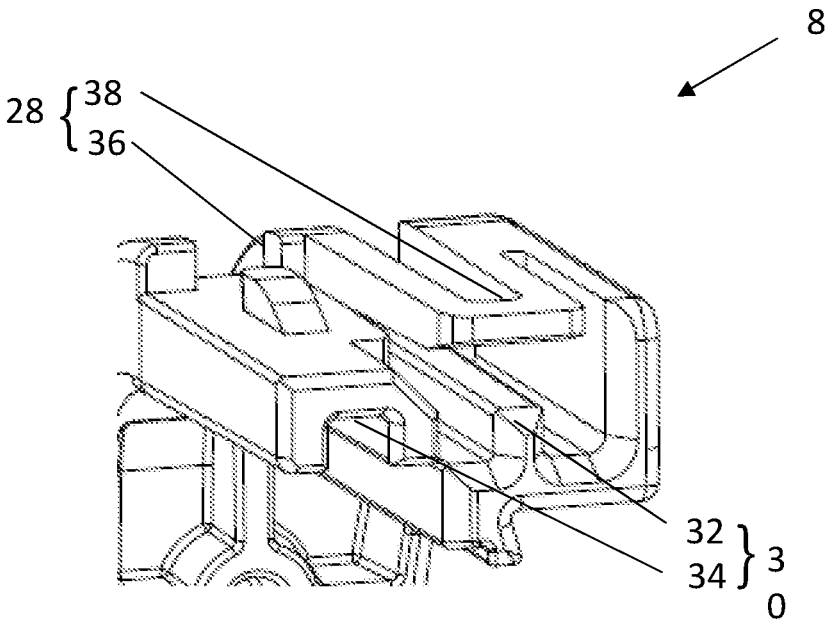
FIG. 3*a* illustrates a perspective view of an interlocking means of the lever arm.
Figure 3B:
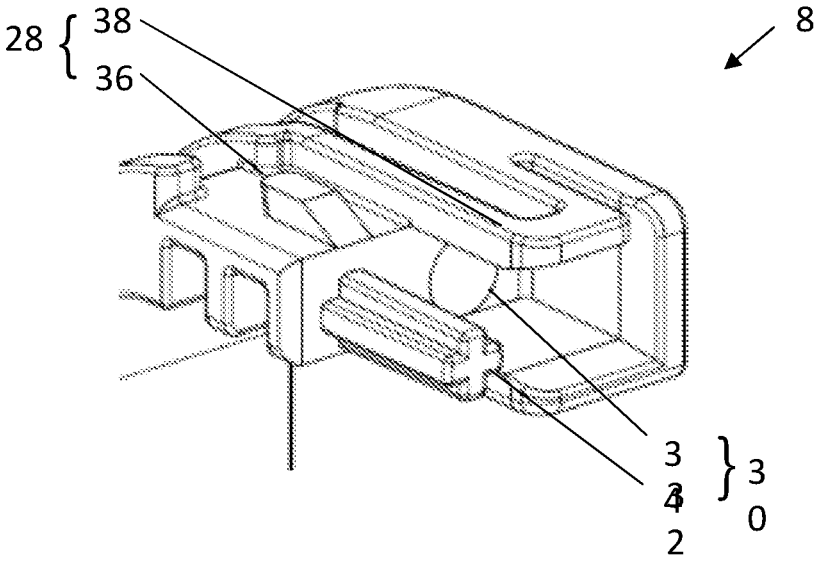
FIG. 3*b* illustrates a perspective view of an alternative embodiment of the interlocking means of the lever arm.

The guiding element 30 includes a protruding elongate member 32 and a corresponding slot 34. As the protruding elongate member 32 includes a major longitudinal axis which is parallel to the direction in which the interlocking means 8 are pushed together, the protruding elongate member 32 ensures the correct alignment of the two interlocking means 8. In use, the protruding elongate member 32 of the first lever arm 6 moves into the corresponding slot 34 of the second lever arm 7, and in parallel the protruding elongate member 32 of the second lever arm 7 moves into the corresponding slot 34 of the first lever arm 6. It will be appreciated that the protruding elongate member 32 and corresponding slot 34 may be configured in a variety of geometries for example two alternative forms for the guiding element 30 are illustrated in FIGS. 3*a* and 3*b*. The guiding element 30 in FIG. 3*a* includes a protruding elongated member 32 of square cross section and a slot 34 in the form of a substantially square aperture in a contacting surface of the guiding element 30. The guiding element 30 of FIG. 3*b* includes a protruding elongated member 32 in the form of a cruciform extrusion and a slot 34 in the form of a substantially circular hole in the contacting surface of the guiding element 30.

Figure 7A:
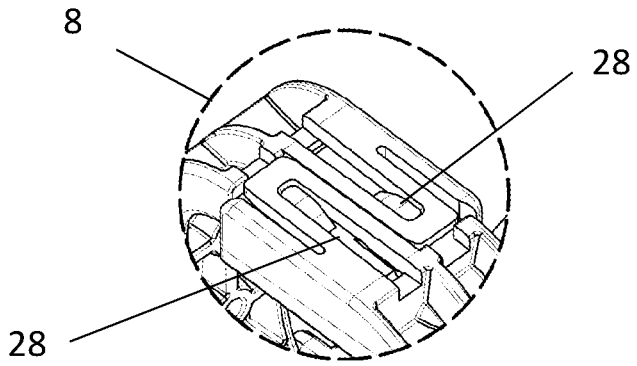
FIG. 7*a* illustrates a perspective view of the interlocking means in the interlocked position.

The locking element 28 of the interlocking means 8 may also be provided with protruding locking member 36 and a resilient member 38 which defines a locking aperture. The guiding element 30, depending on their positions on the interlocking means 8, may be activated prior to the activation of the locking element 28. The resilient member 38 may be configured for providing a locking aperture. In use, the resilient member 38, may be adapted to resiliently deform in order to allow the resilient member 38 to slide over the protruding locking member 36, so that the protruding locking member 36 engages with the aperture defined in the resilient member 38. An example of the interlocked configuration of the first lever arm 6 and the second lever arm 7 is shown in FIG. 7*a*.

As shown in FIG. 2, each lever arm 6 and 7 may be provided with a first mounting member 9, which is configured to cooperate with a complementary second mounting member 10 provided on the connector housing 2. For example, the first mounting means 9 may be a retaining member e.g., in the form of a retaining latch, which is configured to cooperate with a complementary second mounting member 10 provided on corresponding mounting locations on the connector housing 2. The second mounting means 10 may be in the form of a notch 26 that defines a rim 31 on the mounting locations of the connector housing 2. The notch 26 may be in the form of an indentation that defines a channel. The notch 26 is configured to cooperate with the retaining latch 9 of the corresponding lever arm 6 and 7. The second mounting means 10 may be provided in any other desirable form e.g., an opening adapted to engage with a corresponding retaining latch. It should also be noted that in the context of the present application, the first and second mounting means 9 and 10 are interchangeable. As such the second mounting means 10 may be provided on the lever arms 6 and 7 and the first mounting means 9 may be provided on the corresponding mounting locations on the connector housing. Each lever arm, 6 and 7, may be provided with corresponding locking member 16*a* and 16*b* including a gear mechanism 18 provided with at least one gear tooth 22. The locking members 16*a* and 16*b* may have a desired shape e.g., a cylindrical shape. As shown in FIG. 2, the gear mechanism 18 may be symmetrical about an axis of rotation of the lever 5. As shown in FIG. 2, the sealing surface 11 may be provided around the locking members 16*a* and 16*b*. The sealing surface 11 may be surrounded by a raised edge 13 defining a space.

According to an embodiment, the lever arms 6,7 are identical, and as such may be interchangeable with one another, which eliminates the potential for confusion with regards to how the levers arms 6,7 are connected and how they should be orientated on the connector housing.

Figure 4:
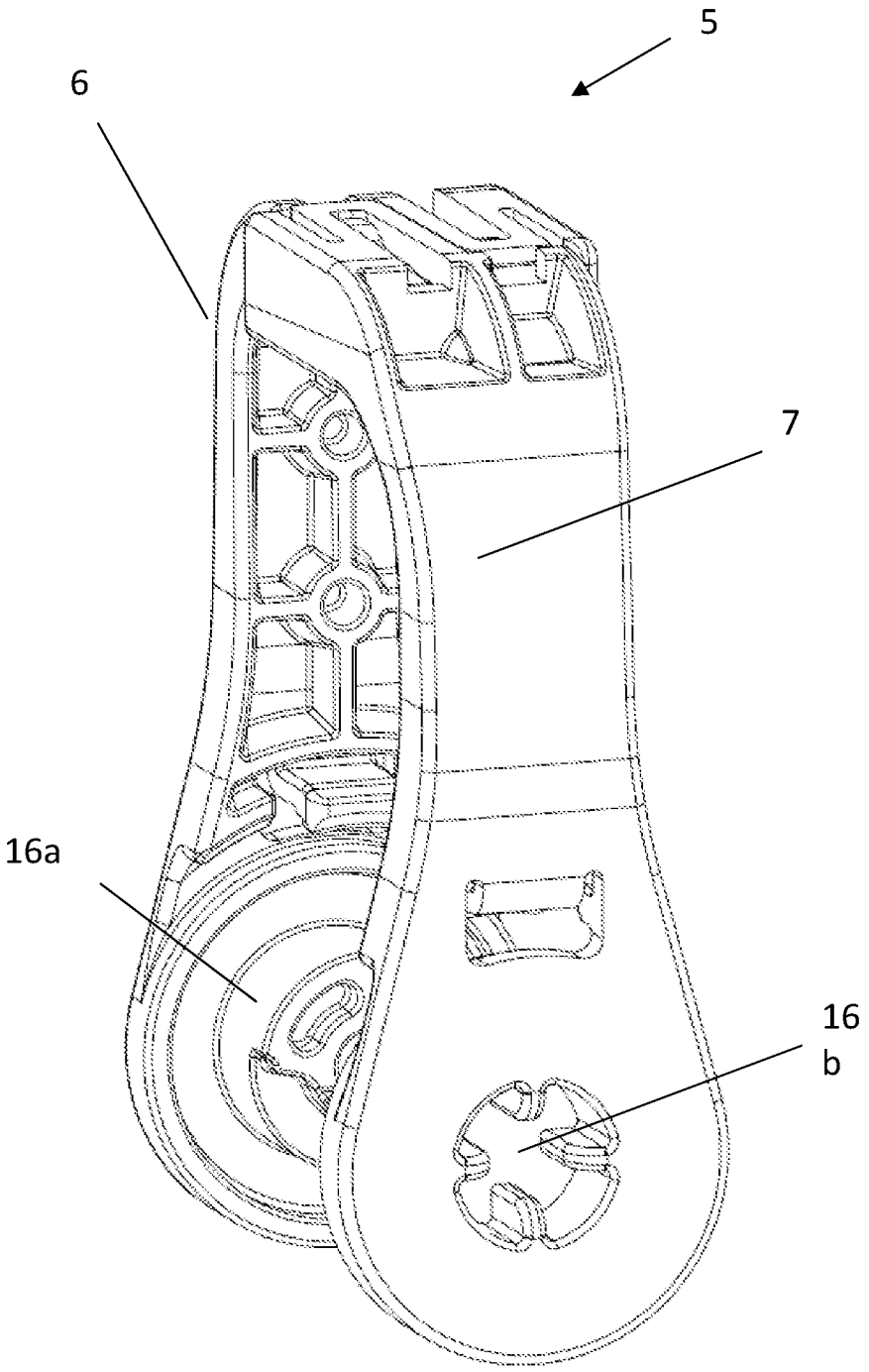
FIG. 4 illustrates a perspective view of the symmetrical split lever in the interlocked position.

FIG. 4 illustrates a view of the first lever arm 6 interlocked with the second lever arm 7 such that they form a U-shaped lever 5. It will be appreciated that, FIG. 4 shows the lever arms 6 and 7 in the interlocked state without the connector housing 2 for illustrative purposes, however, in use, the first lever arm 6 may be assembled directly onto the connector housing 2 prior to being interlocked with the second lever arm 7.

Figure 5:
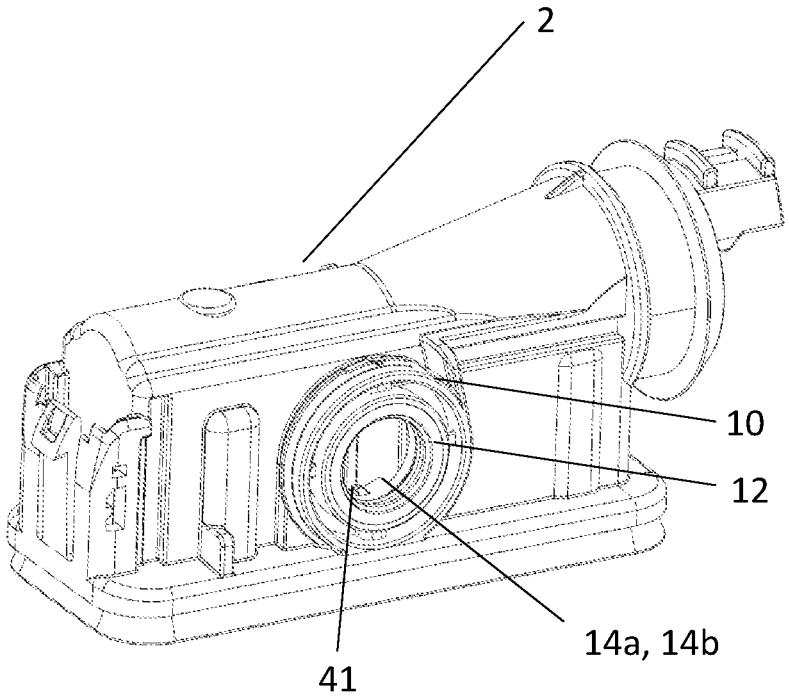
FIG. 5 illustrates a perspective view of a connector housing.

As shown in FIG. 5, the connector housing 2 may be provided with two apertures 14*a* and 14*b* located on opposing sides of the connector housing 2. Each aperture 14*a* and

14*b* is configured to receive a cylindrical locking member 16*a* and 16*b*. Around each aperture 14*a* and 14*b*, a sealing surface 21 may be provided with a raised edge 27 for receiving a sealing member 12. The sealing member 12, may be provided in sealing contact with corresponding sealing surfaces 11 and 21 on each of the lever arms 6 and 7 and the connector housing 2 as shown in FIGS. 7*c* and 7*d*. According to the embodiment shown in FIGS. 7*c* and 7*d*, the raised edge 13 of the sealing surface 11 is configured to be received, when the levers 6 and 7 are mounted on the connector housing 2, at corresponding openings 29 on the connector housing 2, and the raised edge 27 is configured to be received together with the sealing member 12 at the space defined by the raised edge 13. As such, when the lever 5 is mounted on the connector housing 2, water and dust are prevented from entering the connector housing 2. The sealing member 12 may be integrally formed on one of the sealing surfaces 11 and 21 e.g., using a 2K injection molding process. Furthermore, the sealing member 12 may be provided in the form of an independently O ring seal. In use, the sealing member 12 is positioned between each lever arm 6 and 7 and the connector housing 2 such that it prevents moisture and/or dust from entering the interior of the connector housing 2. As shown in FIGS. 5 and 7*c* the sealing member 12 may be provided at locations around the apertures 14*a* and 14*b*. As shown in FIGS. 5 and 7*d*, the second mounting member 10, which is configured to cooperate with the first mounting member 9 of a lever arm 6 and 7, may be in the form of a notch 26 defining a rim 31 provided substantially around each aperture 14*a* and 14*b*. As shown in FIGS. 7*c* and 7*d*, the notch 26 is configured to engage with a corresponding engagement surface of the retaining latch 9 of a lever arm 6 and 7. Once the retaining latch 9 is engaged, the notch 26, is configured to retain the retaining latch 9 within the channel, due to the profile of the retaining latch 9, as the lever 5 rotates between the open and closed states.

Figure 7B:
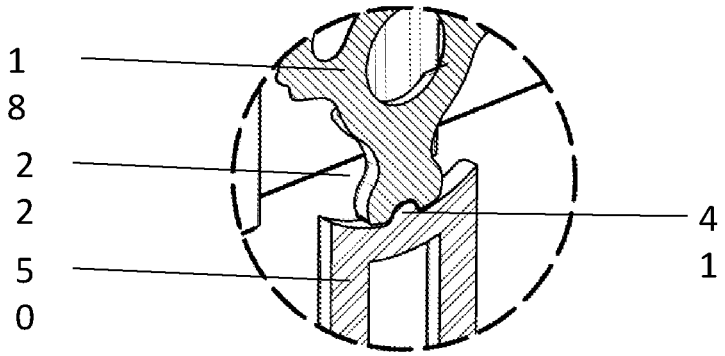
FIG. 7*b* illustrates a perspective cross section view of a gear tooth engaged with a protruding surface of the connector housing 2 in the pre lock position.
Figure 7C:
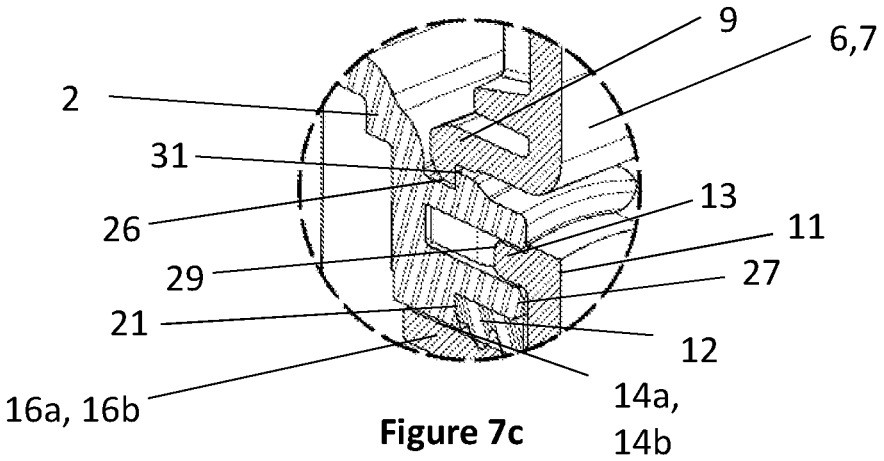
FIG. 7*c* illustrates a perspective cross section view of a retention feature in the form of an elongate arm and corresponding rim.
Figure 7D:
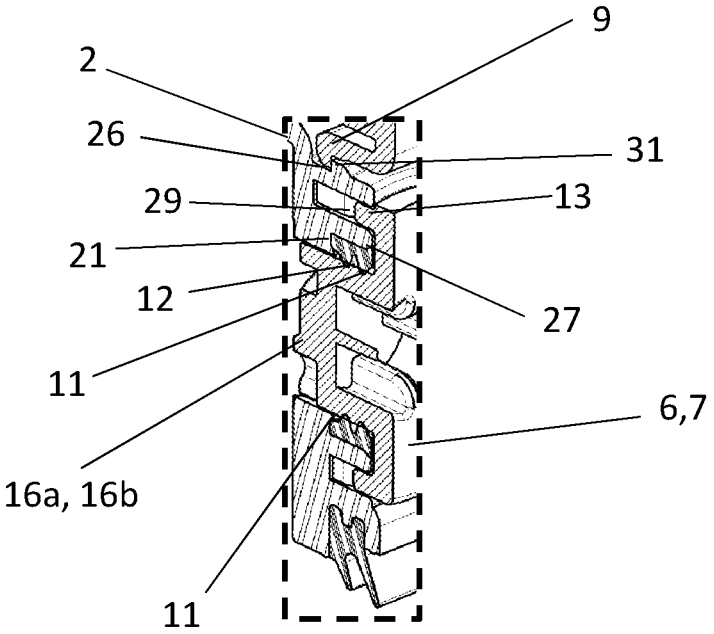
FIG. 7*d* illustrates a perspective cross section view of the lever to connector housing mounting means.
Figure 13:
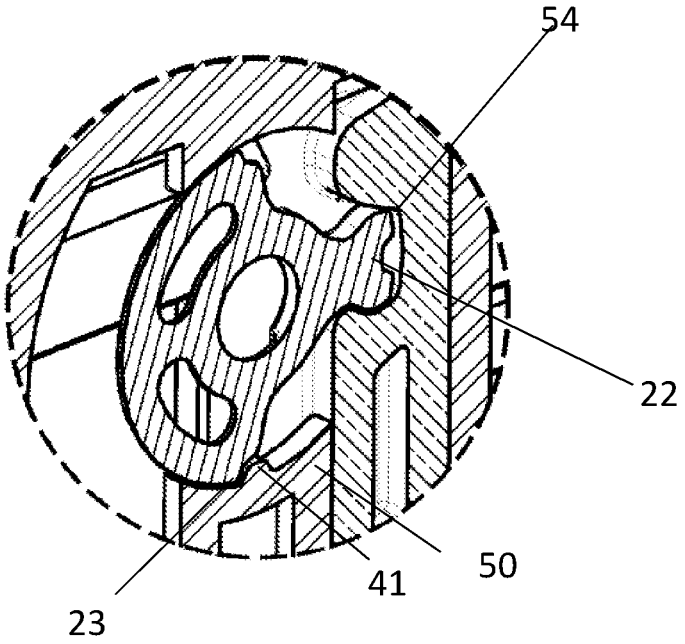
FIG. 13 illustrates an enlarged perspective cross sectional view of the gear when the lever is in the final-lock position such that the gear tooth engages with a recess on a mating surface of the connector housing.

As shown in FIG. 7*b*, when the lever 5 is in the open position, also referred to as pre-lock position, the gear tooth 22 is configured to engage with a protruding member 41 e.g., a node, on surface 50 of the connector housing 2. It will be appreciated that the term engages means that the lever arms 6,7 may be mounted on the connector housing 2, such that the gear mechanism 18 is provided at an orientation to the protruding member 41 as shown in FIG. 7*b*. In order for the gear mechanism 18 to rotate, such that the lever moves from the pre-lock position to the final-lock position, a suitable force is applied to the gear mechanism 18 via the lever 5 causing the gear tooth 22 to move over the protruding member 41 towards the closed position. The surface 50 may be provided with a concave surface, thus allowing the gear mechanism 18 to rotate to the closed position, whereby the gear tooth 22 is configured to engage with a corresponding mating surface of the counter-connector housing 4, and the protruding member 41 engages with a corresponding surface 23 of the gear mechanism 18 as shown in FIG. 13.

Figure 9A:
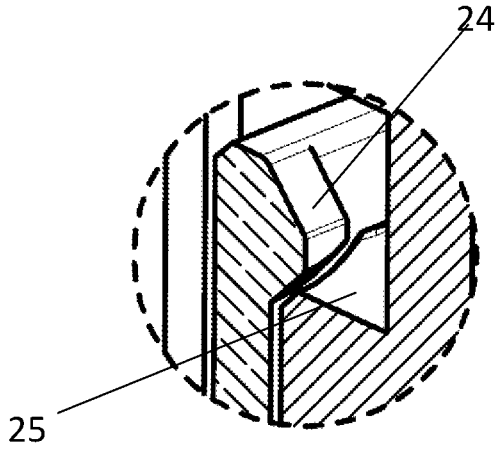
FIG. 9*a* illustrates a perspective cross section view of a boss of the counter-connector and a corresponding mating surface.
Figure 9B:
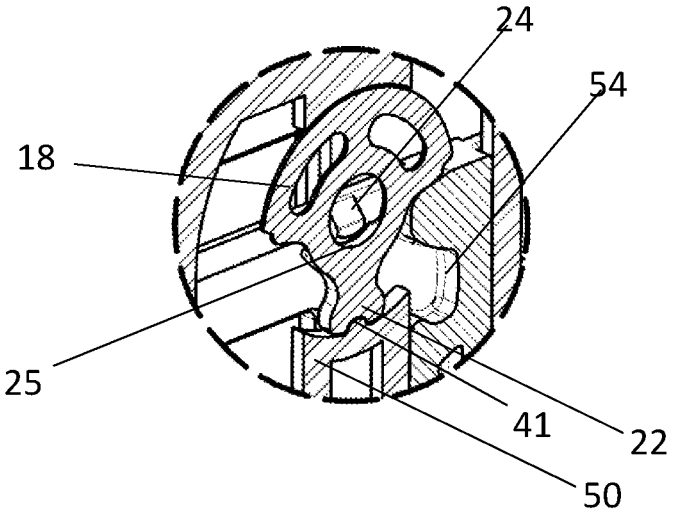
FIG. 9*b* illustrates a perspective cross section view of the boss which is engaged in an internal mating surface of a gear member.

FIGS. 9*a* and 9*b* illustrate the mating sequence of the connector 2 and the counter-connector 4. As shown, the counter-connector 4 is configured to engage with the connector housing 2 via a boss 24 and corresponding engagement surfaces 25. For example, the counter-connector 4 may be provided with one or more bosses or protrusions, which are configured to engage with corresponding mating surfaces 25 e.g., openings, channels and the like, provided on the connector housing 2 and/or the locking member 16*a* and 16*b* of the lever arms 6 and 7, as shown in FIGS. 9*a* and 9*b*.

Figure 10A:
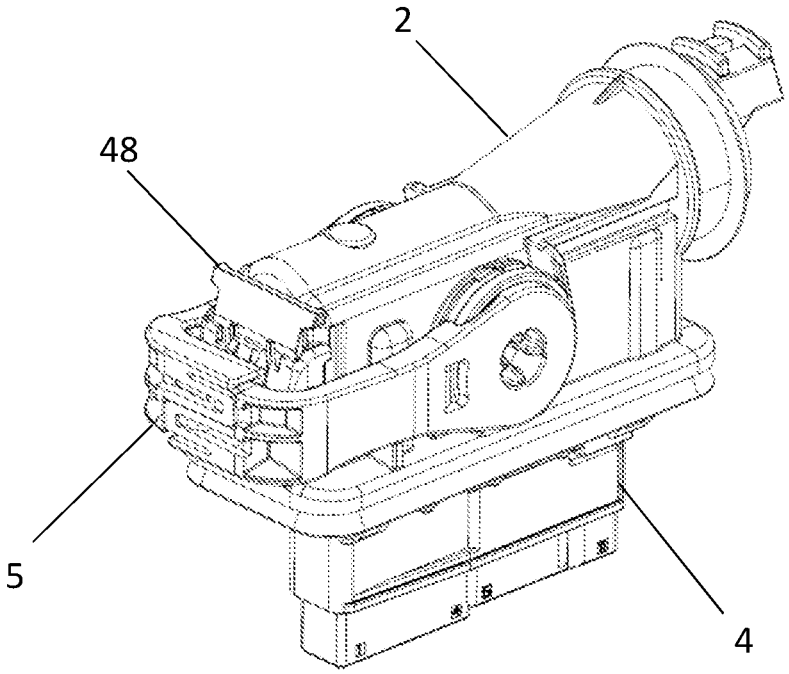
FIG. 10*a* illustrates a perspective view of a sealed electrical connector assembly with a symmetrical split lever wherein the CPA member is in the pre lock position.
Figure 10B:
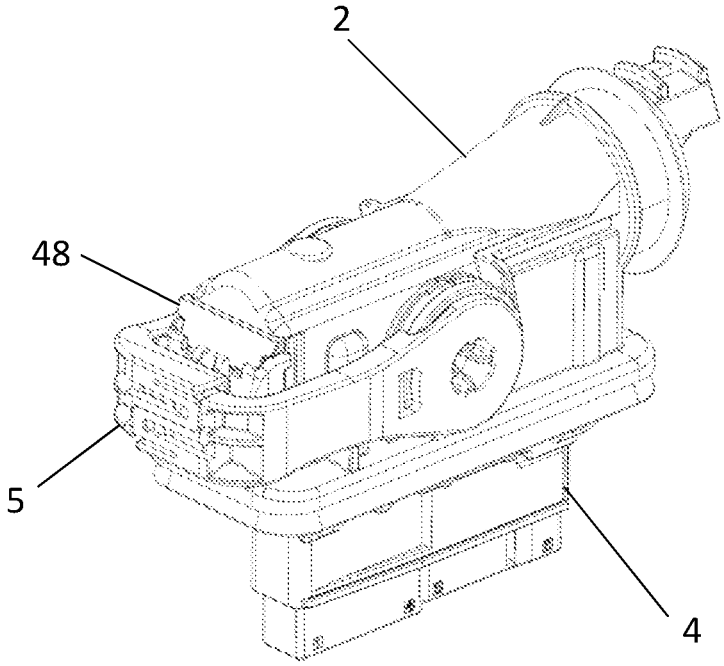
FIG. 10*b* illustrates a perspective view of a sealed electrical connector assembly with a symmetrical split lever wherein the CPA member is in the lock position.
Figure 11A:
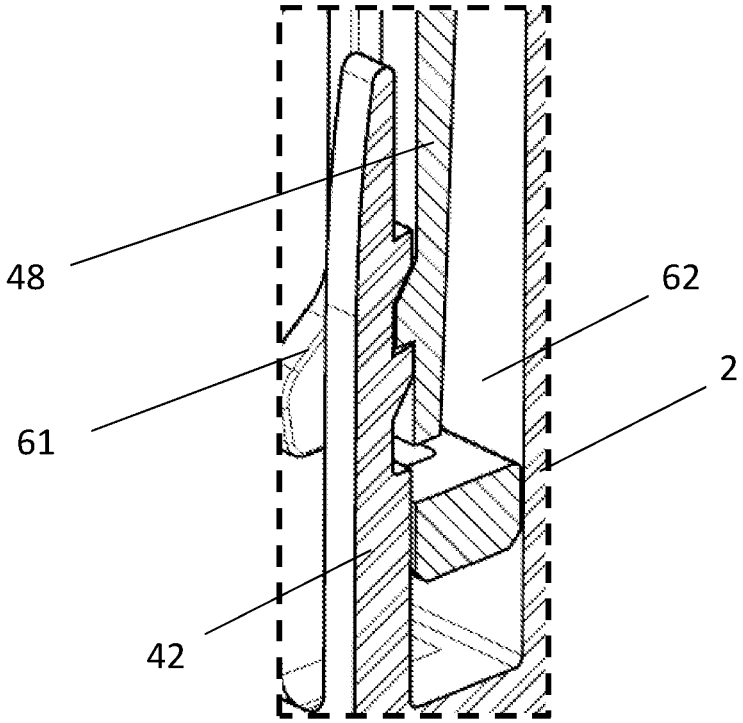
FIG. 11*a* illustrates a perspective cross section view of a CPA member and a corresponding element in the connector housing in a pre-lock position.
Figure 11B:
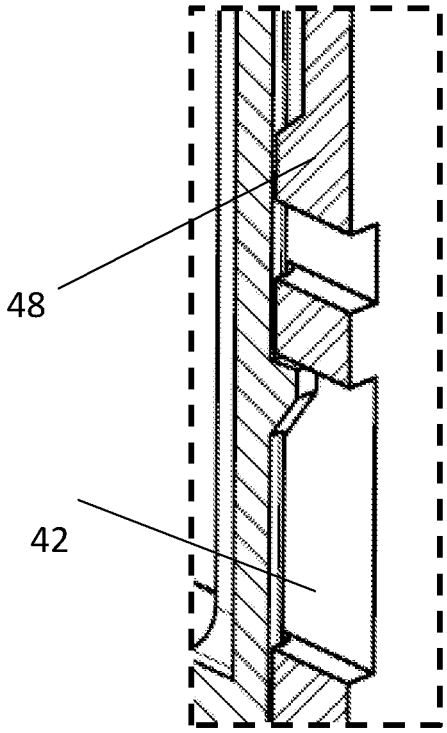
FIG. 11*b* illustrates a perspective cross section view of the CPA member and the corresponding element in the connector housing in a lock position.

FIGS. 10*a* and 10*b* illustrate the connector assembly with the lever 5 in the closed position, also referred to as the final-lock position. A shown, a connector position assurance (CPA) member 48 may be provided and secured in a location between the lever 5 and the connector housing 2. The CPA member 48 is configured to be activated after the lever 5 has been rotated from the open to the closed position. The insertion of the CPA member 48 ensures that the lever 5 is prevented from accidentally rotated away from the closed position during use. Should the need arise to reverse the mating of the connector housing 2 and the counter-connector housing 4 the CPA must be purposefully removed from the electrical connector assembly 100 in order to enable the rotation of the lever 5.

The CPA member 48 includes geometrical features 62 which are configured to engage with corresponding features 47 in the lever 5 as shown in FIGS. 11*a* to 12*e*. In use, the CPA member 48 is slotted into the geometrical features 62 formed between the second connecting means 42 of the connector housing 2 and the main body of the connector housing 2. For example, behind the second connecting means 42, an opening may be provided for inserting the CPA member 48. As shown, the CPA member includes engagement members 61 configured to engage with corresponding features 47 of first connecting means 40 of the lever 5. The CPA member 48 is movable between a start position, and a stop position.

Figure 12A:
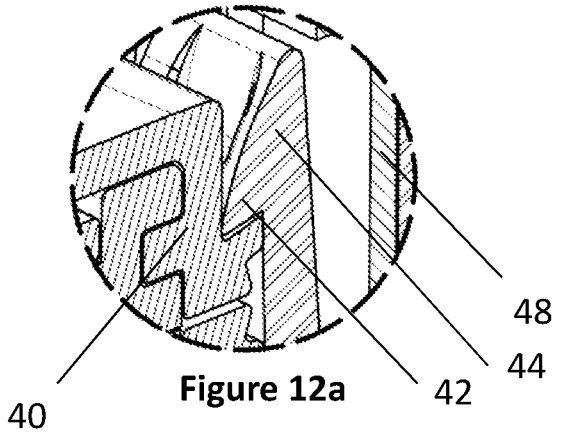
FIG. 12*a* illustrates a perspective cross sectional view of first connecting member of the lever which is engaged by a second connecting member of the connector housing.
Figure 12B:
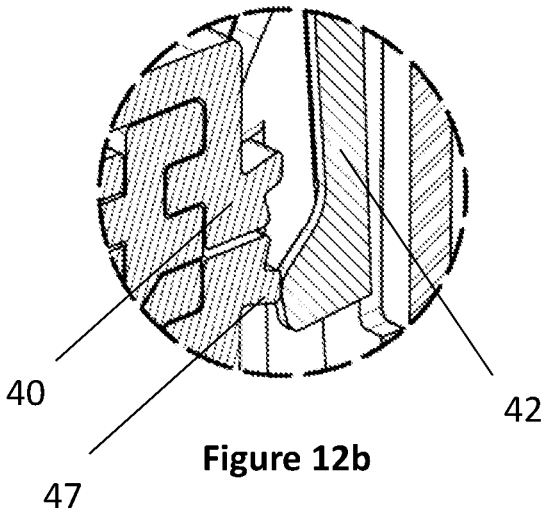
FIG. 12*b* illustrates a perspective cross sectional view of the first connecting means of the lever which is engaged at an intermediate position with the connector housing.
Figure 12C:
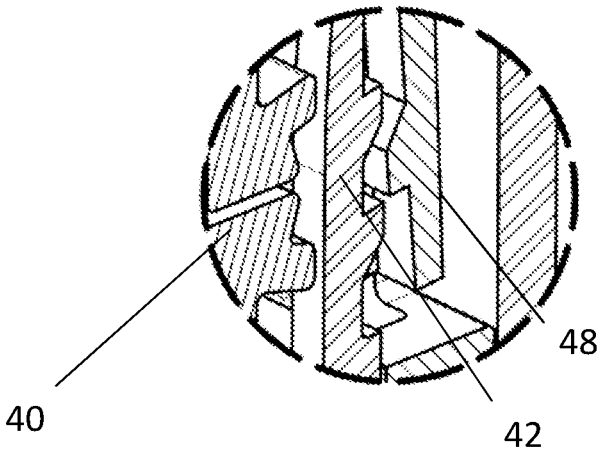
FIG. 12*c* illustrates a perspective cross sectional view of the first connecting means of the lever which is engaged with the second connecting means of the connector housing, which in turn is engaged with the CPA member.
Figure 12D:
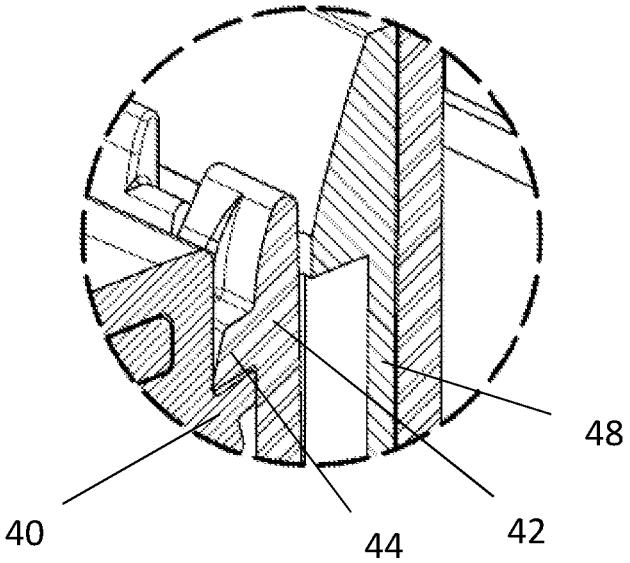
FIG. 12*d* illustrates a further perspective cross sectional view of the three engaged elements of FIG. 12*c;*
Figure 12E:
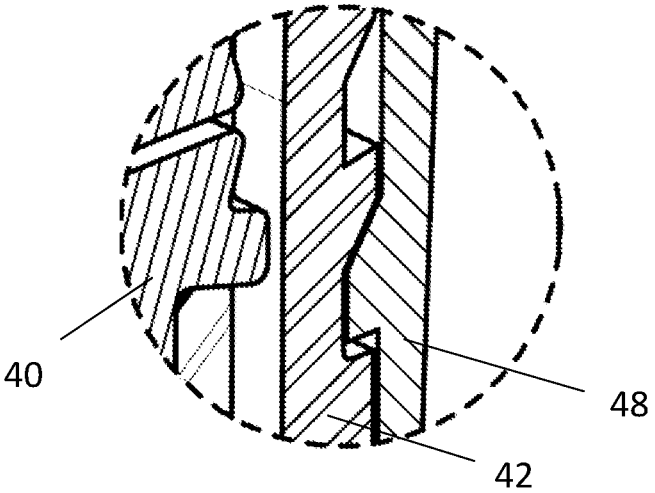
FIG. 12*e* illustrates a further perspective cross sectional view of the three engaged elements of FIGS. 12*c* and 12*d*.

As shown in FIGS. 12*a* and 12*b*, with the CPA member in the start position, when the lever is positioned at the closed state, the first connecting means 40 and the second connecting means 42 are configured to engage. For example, the first and second connecting means 40, 42 may be provided with corresponding engagement elements 44, e.g., in the form of a latch and a corresponding mating surface. Once, the first and second connecting means are engaged, the CPA member 48 is moved from the start position to the end position as shown in FIGS. 12*c* to 12*e*. At the end position, the CPA member 48 exerts a retaining force on the second connecting mechanism 42, and such as accidental movement of the lever is prevented.

FIG. 13 shows a cross-sectional perspective view of the connector assembly with the lever 5 in the closed position. As shown, the gear tooth 22 of the gear mechanism engages with a recess on a mating surface 54 of the counter-connector housing 4. As such, the counter-connector housing 4 is securely connected to the connector housing 2.

Figure 6A:
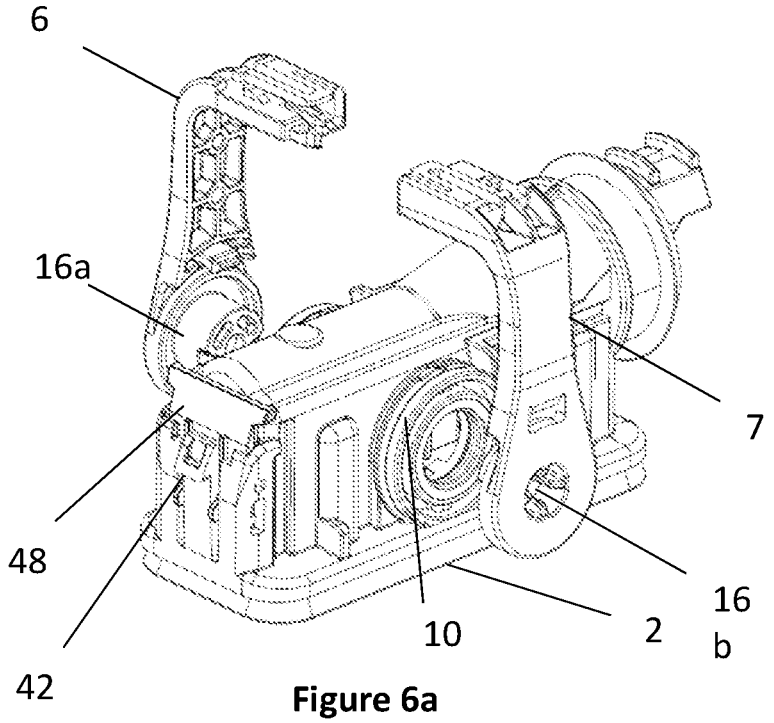
FIG. 6*a* illustrates a perspective view of the first lever arm, the second lever arm and the connector in the unassembled position.
Figure 6B:
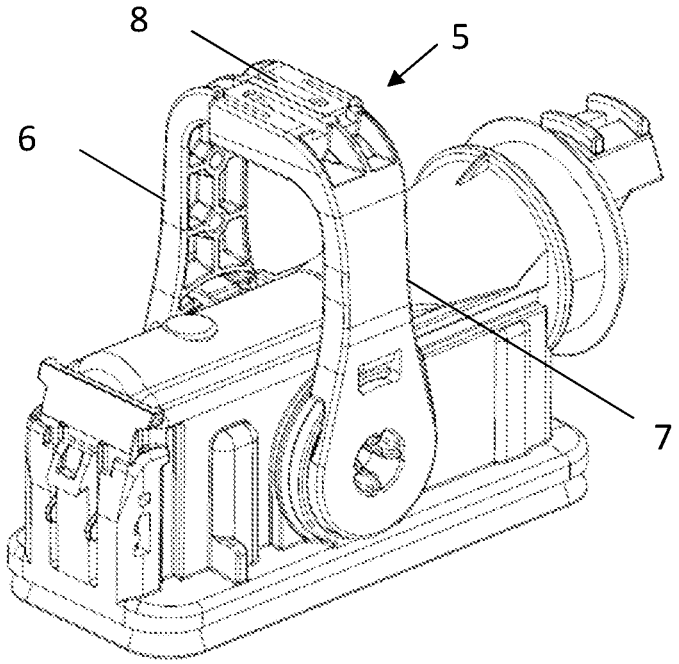
FIG. 6*b* illustrates a perspective view of the first lever arm and second lever arm which are interlocked to form a lever and mounted on the connector housing.

An exemplified method for the connector assembly is described below to illustrate the sequence of activation of the features of the connector assembly with references to FIGS. 6*a*, 6*b*, 8*a*, and 8*b*:

As shown in FIG. 6*a*, the lever arms 6 and 7 are presented at opposing mounting locations on the connector housing 2. Each lever arm 6 and 7 is mounted to the connector housing 2 via the respective first and second mounting means 9, 10 as described above and the corresponding interlocking means 8 are connected to one another, thereby forming the lever 5. With the lever 5 mounted on the connector housing 2, the retaining latch 9 is engaged with a notch 26 in the connector housing 2 as shown in FIG. 6*b*. As the notch 26 in the connector housing 2 forms an arcuate path as described above, the retaining latch 9 is free to rotate without accidentally becoming disengaged, for example to move along the arcuate notch. The sealing member 12 is located on the connector housing 2.

Figure 8A:
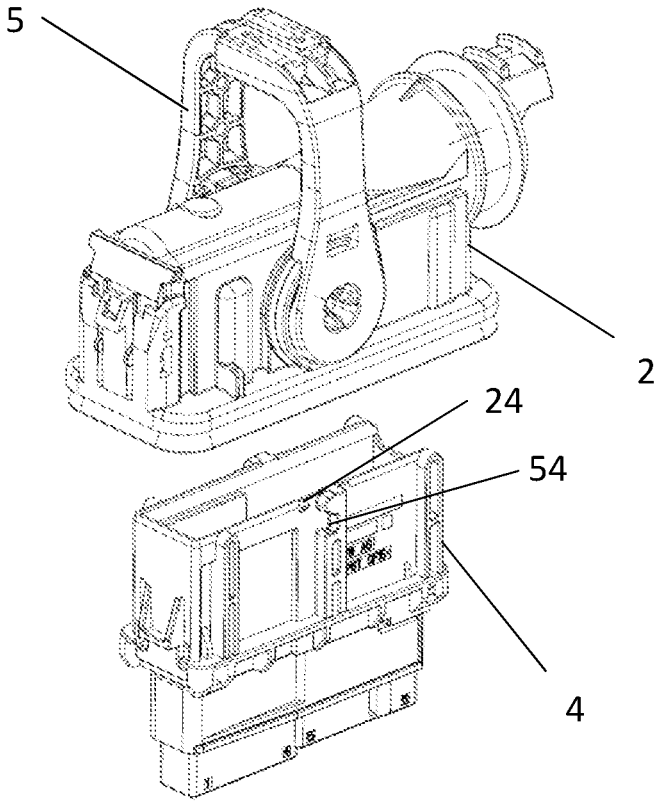
FIG. 8*a* illustrates a perspective view of a sealed electrical connector assembly in an unmated configuration wherein the counter-connector housing has not been inserted into the connector housing.
Figure 8B:
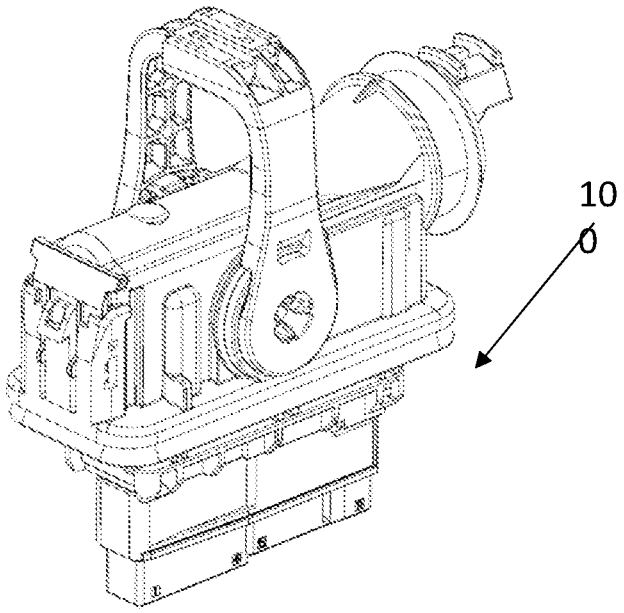
FIG. 8*b* illustrates a perspective view of a sealed electrical connector assembly in a mated configuration wherein the counter-connector has been inserted into the connector housing.

In use, when the lever 5 is mounted on the connector housing 2, the sealing member 12 is in sealing contact with both the lever 5 and the connector housing 2. As the sealing member 12 is ring shaped and it sits within a sealing surface 11 in the mounting means 8, it does not prohibit rotational movement of the lever 5 in relation to the connector housing 2. As shown in FIG. 8*a*, the counter-connector 4 is presented to the connector housing 2. The connector housing 2 and the counter-connector housing 4 may be brought into engagement such that a portion of the counter-connector housing 4 is located inside a portion of the connector housing 2 as shown in FIG. 8*b*. The boss 24, or another engagement element, may be provided on the counter connector housing 4 which cooperates with a corresponding mating surface 25 of the gear as shown in FIGS. 9*a* and 9*b*. The geometry of the mating surface 25 is such that it allows the boss 24 to rotate within the space defined by the mating surface 25 without disengaging from the mating surface 25. As the lever 5 is rotated from the open position, in which it is assembled on the connector housing 2, to a closed position, the connector housing 2 and the counter-connector housing 4 are coupled to one another via the rotatable gear mechanism 18 provided by each lever arm 6 and 7.

As such, the lever 5 acts as a mate-assist device, as it is known in the art, configured to coupling the two connector housings 2 and 4. When the lever 5 reaches the closed position, the at least gear tooth 22 engages with a mating surface 54 such that further motion of the gear mechanism 18, either clockwise or counterclockwise, is discouraged. In addition, when the lever 5 reaches the closed position a first connecting means 40 on the lever engages with a second connecting means 42 on the connector housing, further strengthening the engagement between the lever 5 and the connector housing 2. A CPA member 48 is additionally inserted at this point, which is wedged between the second connecting means 42 and the connector housing 2 such that the first connecting means 40 and the second connecting means 42 cannot disengage from one another.

The invention claimed is:

1. A connector assembly comprising;

a connector housing adapted to engage with a corresponding counter-connector housing; and a lever comprising a first lever arm and a second lever arm, each lever arm comprising interlocking means for connecting the first lever arm to the second lever arm at a first location, each lever arm comprising at a second location a first mounting member configured to cooperate with a complementary second mounting member on the connector housing for pivotably and sealingly mounting each lever arm to a corresponding location on the connector housing;

wherein the interlocking means of each of the first lever arm and the second lever arm are configured to define complementary symmetrical surfaces that interlock with one another when the lever arms are pivotably mounted to the connector housing and, wherein on mounting the lever arms to the connector housing, the lever is configured to move about the connector housing between an open state and a closed state to secure the counter-connector housing to the connector housing.

2. The connector assembly according to claim 1, wherein a sealing member is provided in sealing contact with corresponding sealing surfaces on the lever arms and the connector housing.

3. The connector assembly according to claim 2, wherein the sealing member is integrally formed on each of the lever arms and/or the connector housing.

4. The connector assembly according to claim 3, wherein the sealing member is formed using a 2K injection molding process.

5. The connector assembly according to claim 1, wherein the connector housing comprises two apertures provided on opposing sides of the connector housing, each aperture configured to receive a locking member of a lever arm.

6. The connector assembly according to claim 5, wherein the locking member comprises a locking element which is configured to cooperate, when the lever moves to the closed state, with a mating surface of the counter-connector housing to secure the counter-connector housing to the connector housing.

7. The connector assembly according to claim 6 wherein the locking element is in the form of a gear comprising at least one gear tooth configured to engage with a recess on the counter-connector housing.

8. The connector assembly according to claim 1, wherein the first and second mounting members comprise one of a retaining member and a notch adapted to cooperate with one another for mounting each lever arm to opposing locations on the connector housing.

9. The connector assembly according to claim 8, wherein the notch defines a substantially circular rim configured to engage with a corresponding retaining latch.

10. The connector assembly according to claim 1, wherein the counter-connector housing comprises one or more engagement surfaces adapted to cooperate with one or more corresponding engagement surfaces on the connector housing or the lever arms.

11. The connector assembly according to claim 10, wherein the one or more engagement surfaces comprise at least one boss.

12. The connector assembly according to claim 1, wherein the interlocking means of each lever arm comprise a locking element and a guiding element.

13. The connector assembly according to claim 12, wherein the guiding element comprises a protruding elongate member and a corresponding slot configured for receiving an elongated member of the first or second lever arm.

14. The connector assembly according to claim 12, wherein the locking element comprises a protruding locking member and a corresponding resilient member which defines a locking aperture configured for receiving and securing a protruding locking member of the first or second lever arm.

15. The connector assembly according to claim 1, wherein the lever comprises first connecting means configured to cooperate with corresponding second connecting means on the connector housing for releasably securing the lever on the connector housing, when the lever is in the closed state, wherein the first connecting means and second connecting means comprising interconnecting elements configured to engage with one another.

16. The connector assembly of claim 15, wherein the connector assembly comprises a connector position assurance (CPA) member, the CPA member being movable from a start position to an end position, wherein at the end position the CPA member is adapted to prevent the interconnecting elements from disengaging.

17. The connector assembly according to claim 1, wherein the first lever arm and the second lever arm are substantially symmetrical.

18. The connector assembly according to claim 1, wherein the lever arms are made of a glass fiber reinforced thermoplastic material comprising between 20% to 50% of fiber content.

19. A method for assembling an electrical connector, the electrical connector comprising a connector housing, a corresponding counter-connector housing, and a lever comprising a first lever arm and a second lever arm, each lever arm comprising interlocking means configured to define complementary symmetrical surfaces that interlock with one another when the lever arms are pivotably mounted to the connector housing for connecting the first lever arm to the second lever arm at a first location, the method comprising the steps of:

presenting the first lever arm and the second lever to the connector housing on opposite sides thereof;

biasing the interlocking means of each lever arm towards the interlocking means of another lever arm to effect an interlock of the first and second lever arms, the interlock effecting a sealed connection of the lever arms to the connector housing;

engaging the connector housing with the corresponding counter-connecting housing; and pivoting the lever relative to the connector housing to effect a locking of the connector housing with the corresponding counter-connecting housing.

20. A method according to claim 19, further comprising pivoting the lever arm to the closed state until an audible sound is generated from an engagement of corresponding connecting means provided on the lever arm and the connector housing.

* * * * *